United States Patent [19]

Zarfati

[11] 4,015,353

[45] Apr. 5, 1977

[54] ADVERTISING DISPLAY DEVICE

[76] Inventor: Renato Zarfati, 251 - 174th St., N. Miami Beach, Fla. 33160

[22] Filed: Oct. 14, 1975

[21] Appl. No.: 621,650

[52] U.S. Cl. ..... 40/77

[51] Int. Cl.[2] ..... G09F 11/02

[58] Field of Search ..... 40/77, 68, 74, 33

[56] References Cited

UNITED STATES PATENTS

| | | | |
|---|---|---|---|
| 1,238,419 | 8/1917 | McKinley et al. | 40/77 X |
| 1,589,292 | 6/1926 | Chortanian et al. | 40/33 |
| 2,049,929 | 8/1936 | Schlachman | 40/77 |
| 2,600,157 | 6/1952 | Chrastina | 40/77 |

FOREIGN PATENTS OR APPLICATIONS

| | | | |
|---|---|---|---|
| 338,344 | 11/1930 | United Kingdom | 40/77 |

*Primary Examiner*—John F. Pitrelli

[57] ABSTRACT

An advertising display device comprised of a housing and front bezel defining an interior chamber, a light means such as a flourescent tube, spanning the length of the chamber, an elongated cylindrical shaped assembly, rotatably journaled on the flourescent tube and providing a translucent tubular wall enclosed at its respective ends with cap means; means to removably attach a plurality of advertising display sheets along the length of the outer surface of the translucent wall, and indexing means to sequentially move the advertising display sheets into registration with a front opening in the bezel.

9 Claims, 8 Drawing Figures

ADVERTISING DISPLAY DEVICE

OBJECTS AND ADVANTAGES OF THE PRESENT INVENTION

One of the principal objects of the present invention is to provide an advertising display device which provides a cylindrical shaped assembly, rotatably journaled on a fluorescent light tube, said assembly providing a translucent tubular wall and opposed end caps fixed thereto.

Another object of this invention is to mount the flourescent light tube and cylindrical assembly within a housing, having a front opening.

A further object of this invention is to provide means along the length of the outer surface of the tubular wall to removably attach thereto a plurality of sheets containing any desired indicia.

Yet another object of the instant invention is to provide means to index the cylinder in a manner so as to sequentially move the indicia carrying sheets into registration with the front opening for a predetermined period of time.

DETAILED DESCRIPTION OF THE DRAWINS

Figure 1:
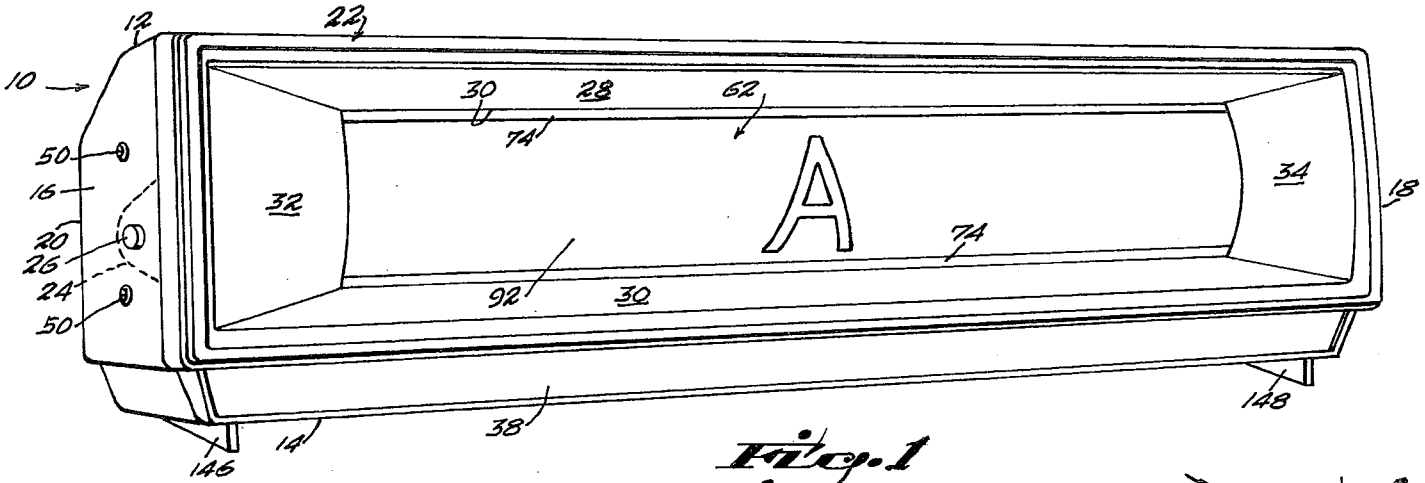
FIG. 1 is a front perspective view of the advertising display device of the present invention.
Figure 2:
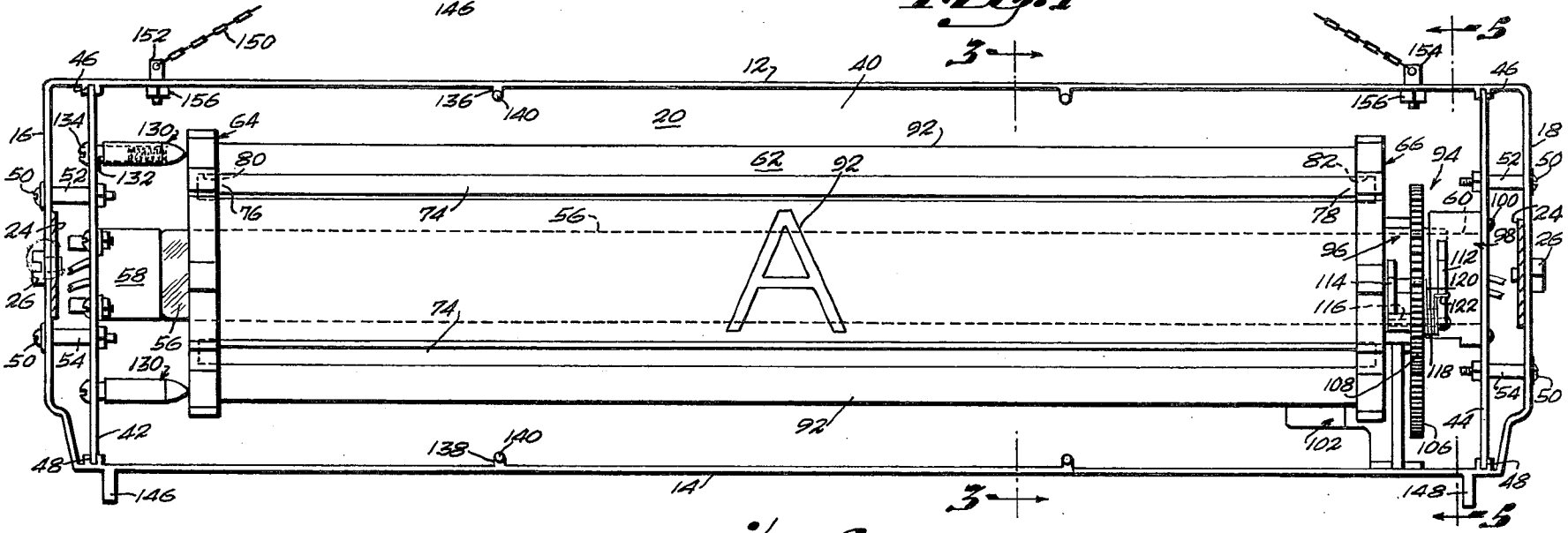
FIG. 2 is a front elevational view of the device with the front bezel removed.

With reference to the drawings in which like reference characters designate like or corresponding parts throughout the various views and with particular reference to FIGS. 1 and 2, the device of the present invention includes a main housing 10 comprised of top and bottom walls 12 and 14, opposed end walls 16 and 18 and a back wall 20, provided with vent slots 21. A front bezel 22 is sized to conform with the front edges of the top, bottom and side walls 12, 14, 16 and 18 and includes a pair of inwardly extending side flange extensions 24 (one shown in FIG. 1) for attachment by screws 26 to the respective side walls 16 and 18.

The bezel may be of any decorative design, however, as illustrated, it includes top, bottom and opposed side, inwardly converging wall portions 28, 30, 32 and 34 to an elongated central opening 36 and an inset bottom panel 38.

As best illustrated in FIG. 2, an interior chamber 40 is defined by the main housing 10 and a pair of inner side plates 42 and 44 are slidably received in upper and lower pairs of grooves 46 and 48 formed integral with the top and bottom walls 12 and 14 adjacent each side wall 16 and 18. The side plates 42 and 44 are spaced somewhat inwardly of the respective side walls 16 and 18. Each side plate 42 and 44 is fixed by a pair of nut and bolt connections 50 to its respective side wall and is spaced therefrom by spacer sleeves 52 and 54 carried on the bolts between the respective plates 42, 44 and side walls 16, 18.

Figure 4:
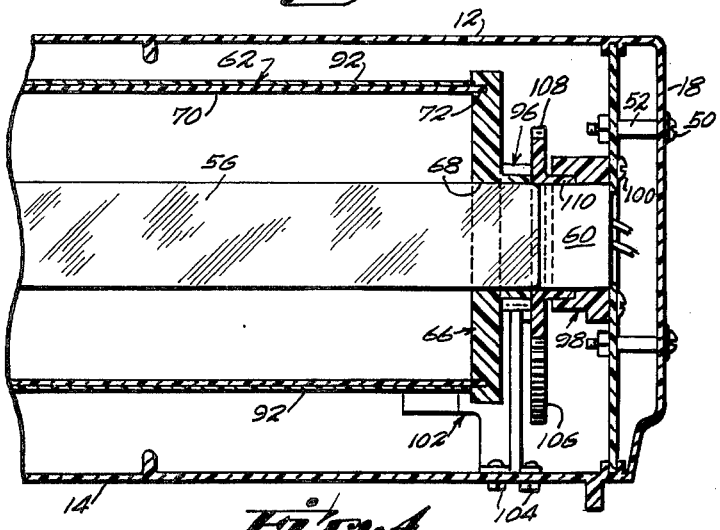
FIG. 4 is a vertical, longitudinal sectional view taken along line 4—4 of FIG. 3.
Figure 5:
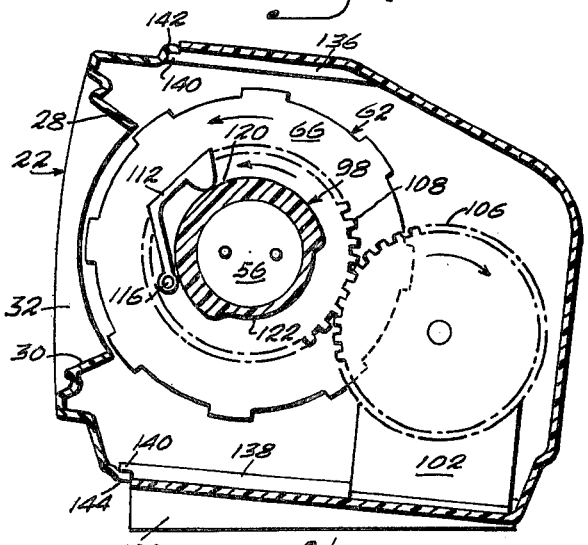
FIG. 5 is a vertical cross sectional view taken along line 5—5 of FIG. 2.

With particular reference to FIGS. 2 and 4, an electric light source such as the fluorescent light tube 56 is disposed longitudinally through the interior chamber 40. A first end of fluorescent tube 56 is engaged in a first terminal 58 fixed in any convenient manner to side plate 42 and the second end thereof is engaged in a second terminal 60 carried by side plate 44 within a cam means which will be subsequently described.

A cylindrical, indicia display assembly 62 is rotatably journaled on the fluorescent tube 56 by means of opposed end caps 64 and 66, each of which is provided with an axial through hole 68 (FIG. 3), for reception of the fluorescent tube 56. An elongated, translucent, tubular member 70 preferably formed of a suitable plastic material, FIGS. 3 and 4, extends between the end caps 64 and 66 in an axial relation to the fluorescent light tube 56. The translucent tube 70 is fixed at its respective ends to the end caps 64 and 66 as indicated at 72 in FIG. 3, relative to end cap 66.

Figure 3:
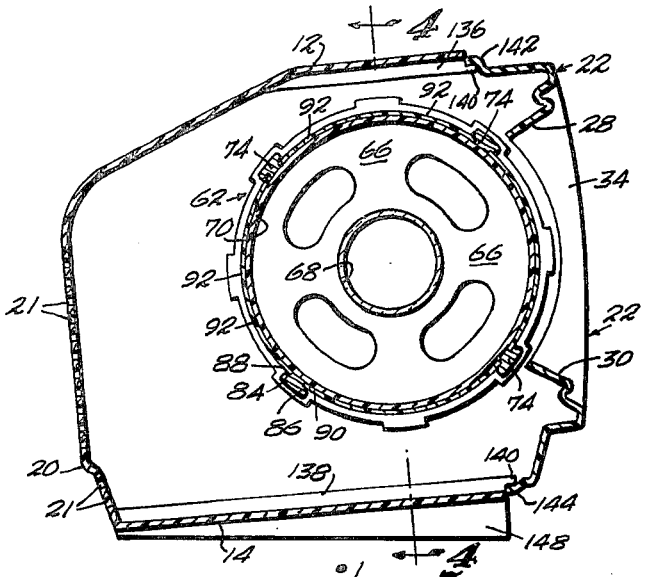
FIG. 3 is a vertical cross sectional view taken along line 3—3 of FIG. 2.

A plurality of elongated strips 74, four illustrated, longitudinally extend in a fixed, parallel, equally spaced apart relation along the outer surface of the translucent tube 70. As illustrated in FIG. 1, the opposed ends 76 and 78 of each strip are captivated in recesses 80 and 82 in the respective end caps 64 and 66. With reference to FIG. 3, the opposed longitudinal edges of each strip 74 are undercut as at 84 and 86 to removably receive the opposed longitudinal edge portions 88 and 90 of the four indicia carrying sheets 92 which are preferably formed of a suitable, flexible, thin plastic material. The sheets 92 extend the full length of the drum between the inner annular edges of the end caps 64 and 66 and are readily exchangeable. Alternatively, two or more indicia sheets which are properly proportioned lengthwisely may be removably inserted between two longitudinal strips 74. If desired, relatively narrow, flexible divider strips may be inserted therebetween.

With particular reference to FIG. 2, an indexing drive means is indicated generally at 94. A four tooth ratchet 96 is formed integral with the end cap 66 and a cam member 98 is fixed to the plate 44 as by screws 100 or by any other convenient means. A motor and speed reducer assembly 102, fixed to the housing 10 as at 104, drives a gear 106 in engagement with a driven gear 108. As best seen in FIG. 4, the driven gear 108 is rotatably journaled on the fluorescent light tube and terminal assembly 56 and 60, and includes an outwardly extending annular flange 110 journaled within the cam member 98.

Referring to FIG. 2, the driven gear 108 carries a cam follower 112 and a pawl 114 on opposite sides thereof. Said cam follower 112 and pawl are rigidly fixed to a common pin 116 rotatably journaled through the gear 108. The cam follower 112 is constantly tensioned against the surface of the cam member 98 by a helical spring 118 circumposed about the cam follower sleeve and providing extended end portions 120 and 122 connecting the spring 118 between the driven gear 108 and cam follower 112. The movements of pawl 114, therefore, conform with the movements of the cam follower 112.

Figure 6:
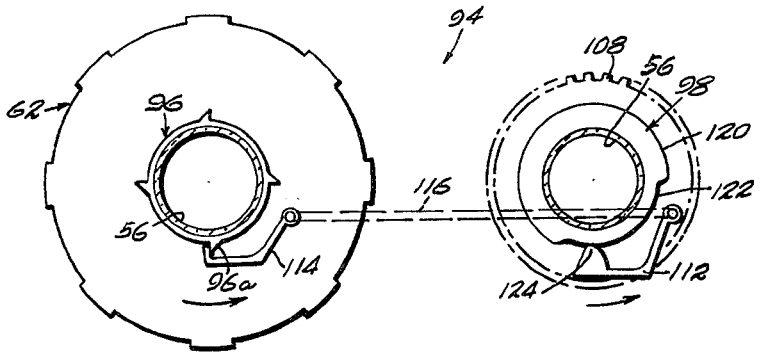
FIGS. 6, 7, and 8 are a series of schematic illustrations of the indexing sequence of the indicia carrying cylinder of the device.

With reference to the series of schematic illustrations of FIGS. 6, 7 and 8, the operation of the cam follower and pawl with reference to the ratchet 96 and cam member 98 will be described in detail. The cam member 98 provides a high portion 120 which is substantially longer than a low portion 122. When the nose portion 124 of the cam follower enters into engagement with the low 122 as in FIG. 6, the pawl 114 moves into position to engage one tooth 96*a* as in FIG. 6. Continued counterclockwise movement of the driven gear 108 rotates the cylinder 62 by means of the pawl engagement with ratchet tooth 96*a* until the cam nose portion emerges from the low 122 onto the high as in FIG. 7. The pawl 114 thereupon automatically becomes disengaged from ratchet tooth 96*a* after rotational movement of the ratchet and cylinder through ninety degrees.

Figure 7:
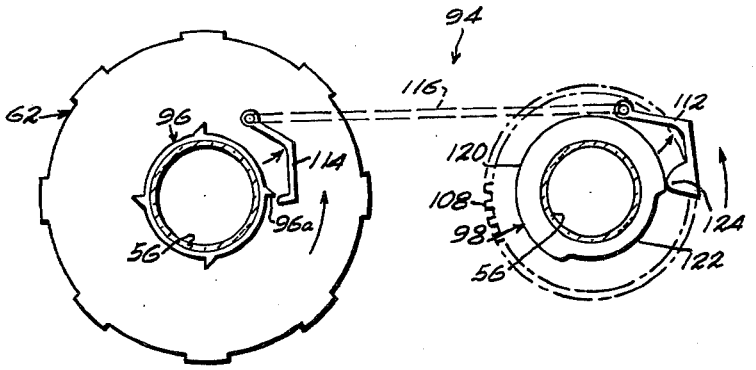
Figure 8:
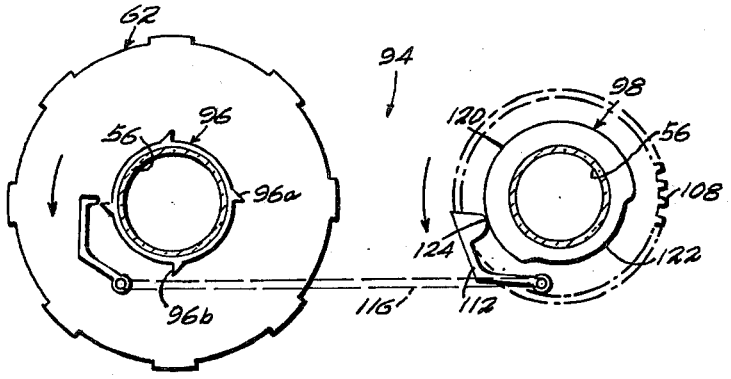

As seen in FIG. 8, the nose 124 of cam follower 114 is approaching the low 122 which is sized to move the pawl 114 inwardly in a timed relation to engage ratchet tooth 96*b* and to move it to the position of tooth 96*a* in FIG. 7.

Therefore, it can be seen that one complete rotation of driven gear 108, rotates the display cylinder through ninety degrees to place one of the indicia sheets in registration with bezel opening 36 for three quarters of the period of time required for one complete rotation of said driven gear 108.

As seen in FIG. 2, a pair of spring loaded plunger members 130 are slidably engaged on studs 132, fixed to plate 42 as at 134 to maintain the cylinder 62 in its proper longitudinal position on the flourescent light bulb 56.

Transverse stiffening strips such as 136 and 138 are integrally molded with and along the inside faces of the top and bottom walls 12 and 14. The strips 136 and 138 terminate in short outer pin portions 140 to support the edges 142 and 144 of top and bottom flanges of bezel 22.

Wedge shaped support legs 146 and 148 are integrally molded with the bottom wall adjacent the respective side walls 16 and 18.

A hanger chain 150, FIG. 2, may be anchored to upstanding studs 152 and 154 adjacent the respective ends of the housing 12. Inwardly projecting screw threaded portions of the studs receive fastening bolts 156.

Various changes and modifications in shape, size and proportions of the device can be made without departing from the true spirit of the invention as defined in the appended claims. For example, the speed of the motor drive to the driven gear may be varied, the diameter of the cylinder 62 may be increased, the number of indicia sheets 92 may be decreased or increased, to eight for example, the number of cam lows 122 may be one, two or more for each rotation of the cam follower and pawl, with a proportionate increase in the number of ratchet teeth 96 and indicia display sheets on the cylinder 62.

What is claimed is:

1. A device for displaying a variety of indicia comprising:

a main housing comprised of top, bottom, back and opposed end walls defining an interior chamber with an open front;

a front bezel, fixed relative to said open front, and including a front opening of predetermined dimensions;

a fluorescent light tube extending longitudinally through said chamber in electrical connection with a pair of opposed end terminals, fixed relative to a pair of opposed end plates fixed within said chamber, adjacent the respective end walls, each of said vertical end plates is slidably engaged in aligned, transverse grooves in said top and bottom walls and is fixed to one of said end walls by nut and bolt means between said one end wall and said end plates;

a cylindrical indicia display assembly rotatably journaled on said fluorescent light tube in an axial relationship therewith, said indicia display assembly being comprised of a longitudinally extending translucent tubular member and a pair of opposed end closure caps;

a plurality of longitudinally extending strips in a fixed, parallel, spaced apart relation along the outer face of said translucent tubular member for removable reception, between each adjacent pair thereof, of a sheet provided with indicia;

a drive motor with a speed reducer carrying a drive gear engaged with a driven gear, said driven gear being rotatably journaled on the axis of said fluorescent light tube;

indexing means actuated by said driven gear to periodically, sequentially rotate the indicia sheets into registration with said bezel opening, said indexing means comprises a ratchet, providing a plurality of teeth, formed integral with one end cap of said cylindrical display assembly, a drum type cam fixed relative to said fluorescent tube and cylindrical display assembly, a spring loaded cam follower, in engagement with said cam, and a pawl fixed for like pivotal movement on opposed ends of a common pin journaled through said driven gear which is rotatably sandwiched between said ratchet and cam, said cam providing high and low portions to impart like relative, pivotal movements to said cam follower and pawl, upon rotational movement of said driven gear, to pivot said pawl into sequential engagement with each one of said ratchet teeth to cause rotational movement of said indicia display assembly through a predetermined number of degrees during each rotation of each driven gear, and out of engagement therewith to arrest said rotational movement during the balance of each rotation of said driven gear.

2. The device as defined in claim 1 wherein the opposed longitudinal edges of said strips are undercut to receive respective longitudinal edge portions of said indicia sheets.

3. The device as defined in claim 1 wherein the opposed end portions of each of said strips are captivated in recesses formed in said end caps.

4. The device as defined in claim 1 wherein said plurality of strips comprises four equally spaced apart strips for the reception of four of said indicia sheets.

5. The device as defined in claim 4 wherein said ratchet includes four teeth, spaced at 90° intervals therearound.

6. The device as defined in claim 5 wherein said cam low is of a length so as to cause movement of said pawl into sequential engagement with each one of said teeth to provide a 90° movement thereto with each complete rotation of said driven gear, to sequentially rotate each one of said four indicia sheets into registration with said bezel opening.

7. The device as defined in claim 6 wherein said cam high is of a length so as to cause said cam follower to maintain said pawl out of engagement with said ratchet for 270° of each rotation of said driven gear.

8. The device as defined in claim 1 wherein said indicia sheets are formed of a suitable thin plastic material which permit the passage of light, from said fluorescent tube, therethrough.

9. The device as defined in claim 1 including spring loaded plunger means, fixed relative to a first of said end plates in engagement with said cylinder in a manner so as to maintain same in a proper longitudinal position relative to said driven gear, cam and a second of said end plates.

* * * * *